US007555922B1

(12) United States Patent
Berlin

(10) Patent No.: US 7,555,922 B1
(45) Date of Patent: Jul. 7, 2009

(54) ELASTIC FABRIC

(75) Inventor: Donald R. Berlin, Jamestown, NC (US)

(73) Assignee: EFA Holdings, LLC, Greensboro, NC (US)

( * ) Notice: Subject to any disclaimer, the term of this patent is extended or adjusted under 35 U.S.C. 154(b) by 113 days.

(21) Appl. No.: 11/428,480

(22) Filed: Jul. 3, 2006

Related U.S. Application Data

(60) Provisional application No. 60/754,341, filed on Dec. 28, 2005.

(51) Int. Cl.
*D04B 21/18* (2006.01)

(52) U.S. Cl. ..... 66/195; 66/85 R

(58) Field of Classification Search ..... 66/192, 66/193, 195, 172 E, 85 R, 84 R
See application file for complete search history.

(56) References Cited

U.S. PATENT DOCUMENTS

| | | | | | |
|---|---|---|---|---|---|
| 3,552,154 | A * | 1/1971 | Lesley | 66/192 |
| 4,009,597 | A * | 3/1977 | Wall et al. | 66/193 |
| 4,248,064 | A * | 2/1981 | Odham | 66/192 |
| 4,320,634 | A | 3/1982 | Hashimoto et al. | |
| 4,688,403 | A | 8/1987 | Gajjar | |
| 4,733,545 | A * | 3/1988 | Weinle et al. | 66/202 |
| 4,802,346 | A | 2/1989 | Gajjar | |
| 4,818,316 | A * | 4/1989 | Weinle et al. | 156/88 |
| 4,844,969 | A | 7/1989 | Chang | |
| 5,029,457 | A | 7/1991 | Gajjar | |
| 5,125,246 | A * | 6/1992 | Shytles | 66/193 |
| 5,265,445 | A * | 11/1993 | Shytles et al. | 66/192 |
| 5,403,267 | A | 4/1995 | Pearce et al. | |
| 5,994,612 | A | 11/1999 | Watkins | |
| 6,079,236 | A * | 6/2000 | Ives et al. | 66/170 |
| 6,446,471 | B1 | 9/2002 | Kaplancali | |
| 6,516,637 | B1 * | 2/2003 | Fancher et al. | 66/170 |
| 6,840,066 | B2 * | 1/2005 | Dickerson | 66/192 |
| 2002/0184925 | A1 | 12/2002 | McClellan et al. | |
| 2004/0237597 | A1 | 12/2004 | Oya et al. | |
| 2005/0112975 | A1 | 5/2005 | McMurray | |

FOREIGN PATENT DOCUMENTS

| | | | |
|---|---|---|---|
| JP | 7070893 | A | 3/1995 |

* cited by examiner

*Primary Examiner*—Danny Worrell
(74) *Attorney, Agent, or Firm*—Smith Moore Leatherwood LLP

(57) ABSTRACT

An improved elastomeric fabric that is knitted with three guidebars on a warp knitting machine including a non-elastic yarn that is knit in on the first guidebar, a first elastic yarn that is knit-in on the second guidebar, and a second elastic yarn that is laid-in on the third guidebar. The elastic yarn has a denier in the range from about 20 to about 105 and the second elastic yarn has a denier in the range from about 70 to about 560. The fabric provides improved durability and power characteristics. The fabric can also be constructed to have improved stretch characteristics such as substantially square stretch or unbalanced stretch with greater fill (width) stretch than warp (length) stretch.

21 Claims, 1 Drawing Sheet

ELASTIC FABRIC

This application claims the benefit of provisional application Ser. No. 60/754,341, filed Dec. 28, 2005.

The present invention is directed towards a warp knit elastomeric fabric having improved durability and stretch characteristics, and a method of making the same.

Prior art methods of making elastic fabrics include warp knitting and weft insertion techniques. Warp knit raschel and tricot fabric constructions are fabricated on a warp knitting machine with one or two bars of inelastic yarn combined with one bar of elastic yarn. The elastic yarn is laid in for raschel constructions or knit in for tricot constructions.

Balanced stretch and/or balanced power characteristics are difficult to achieve for fabrics made from these prior art warp knitting techniques. Particularly, raschel knit fabrics typically have an unbalanced stretch ratio of 2:1 up to 5:1, warp (length) to fill (width). Substantial power can be achieved in one direction in such raschel knit fabrics by using large deniers of elastic yarn, however, this causes the stretch ratio to move closer to 5:1, warp (length) to fill (width). In tricot constructed fabrics, balanced stretches can be achieved but minimal power can be generated due to the relatively small deniers of elastic yarns that are used to make the fabric. If large deniers of elastic yarns are used, the stretches are unbalanced in the typical direction of greater fill (width) stretch than warp (length) stretch and the power characteristics are not as desirable as the power characteristics obtainable in a raschel constructed fabric.

Further, prior art raschel and tricot knit fabrics tend to have undesirable durability characteristics, namely, core retraction, slip back (runs), frayed edges, bunched or distorted loops, and spandex ends broken or pulled away from the seam.

Unlike warp knit raschel and tricot fabric constructions, fabrics created by weft insertion, in which a warp laid in yarn is combined with a weft or filling laid in elastic yarn, have better durability and substantially square performance in terms of stretch and power characteristics. However, the creation of fabric using the weft insertion technique requires the use of a weft insertion machine. Such machines are expensive to obtain and operate and, therefore, add to the costs of the final product.

Accordingly, there is a need in the art for an elastomeric fabric having improved durability and stretch characteristics, and method of economically making the same.

DETAILED DESCRIPTION OF THE PRESENT INVENTION

The present invention solves this need in the art by providing a method of making an elastomeric fabric that replicates the durability and performance of an elastomeric fabric constructed by weft insertion.

Figure 1A:
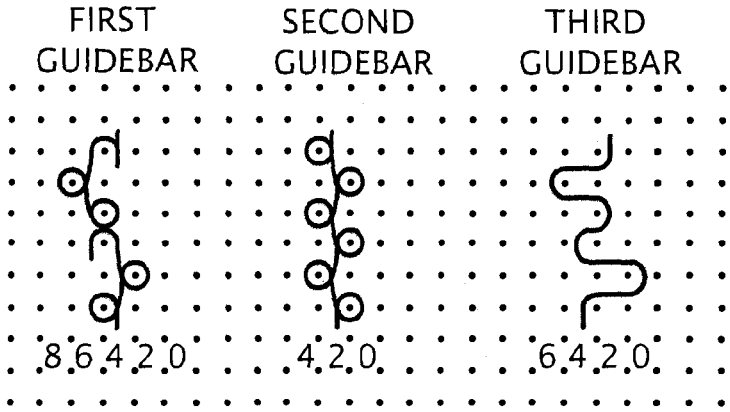
FIGS. 1A-1C are stitch pattern diagrams for fabrics made in accordance with the present invention.
Figure 1B:
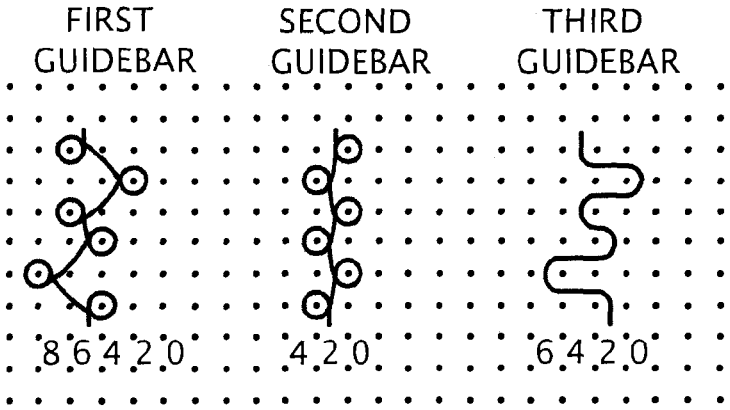
Figure 1C:
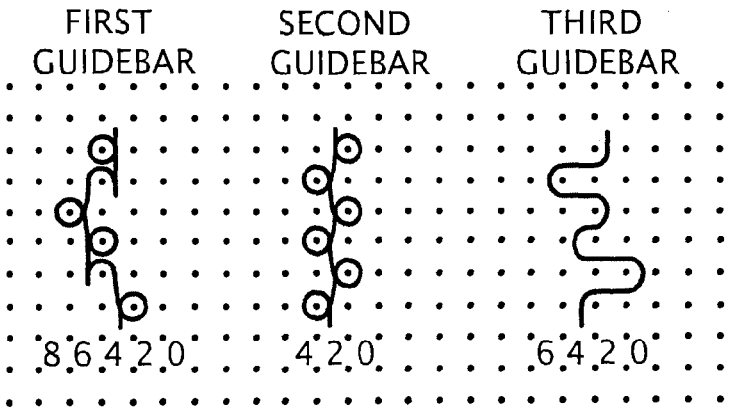

A standard warp knitting machine may be used to construct the fabric of the present invention. As shown in FIGS. 1A-1C, the first guidebar of a three guidebar machine is threaded with a rigid, inelastic yarn such as polyester or nylon yarn. The synthetic yarn preferably has a denier ranging from about 20 to about 100. The second guidebar (middle) guidebar is threaded with an elastic yarn that is knit in and the third guidebar is threaded with an elastic yarn that is laid in. This method of knitting in the elastic yarn on the middle bar and laying in the elastic yarn on the third bar creates a fabric having improved durability and stretch characteristics over fabrics constructed with an elastic yarn laid in on the second bar and knit in on the third bar, as explained in more detail below.

The elastic yarns used in the second and third guidebars may be any type of elastic fibers or yarns that are generically known in North America as spandex, which is a fiber known for its elasticity. Spandex fibers are formed from a long chain synthetic polymer that comprises segmented polyurethane. The fabric construction of the present invention shows improved durability, stretch, and power characteristics when the knit in elastic yarn on the second bar is a small spandex yarn having a denier in the range from about 20 to about 105, and when the laid in elastic yarn on the third guidebar is a large spandex yarn having a denier in the range from about 70 to about 560. Particularly, by virtue of the larger elastic yarn on the third guidebar being fused with the smaller elastic yarn in the middle bar, the resulting fabric is more durable and has improved stretch characteristics. Also, the resulting fabric is less bulky and less expensive to make than if the large elastic yarn were knit in on the middle bar and the small elastic yarn were laid in on the third guidebar. This is because knitting in a yarn when constructing a fabric consumes as much as five times more yarn than laying in the yarn. Thus, if the larger denier yarn is knit in, the resulting fabric is thicker and bulkier and the stretch characteristics are not as desirable.

As shown in Table 1 below, the elastomeric fabric constructed in accordance with the present invention, namely with a smaller denier elastic yarn knit in on the middle bar and a larger denier elastic yarn laid in on the third guidebar, produces a dimensional stability and durability not found in either raschel or tricot constructions. Additionally, the fabric of the present invention can be produced to have generally balanced stretch characteristics, as shown in TEST 1, or with substantially unbalanced stretch in the inverse direction, namely greater fill (width) stretch than warp (length) stretch, as shown in TEST 3. This unbalanced stretch in the inverse direction provides improved and desirable stretch over prior art raschel and tricot fabrics which have unbalanced stretch characteristics of greater warp (length) stretch than fill (width) stretch. Furthermore, the fabric of the present invention can be constructed with traditional warp knitting machines, and does not require the use of a special weft insertion machine.

A warp knitting machine was employed to produce certain fabrics as follows:

TABLE 1

| | TEST 1 | TEST 2 | TEST 3 | COMPARE 1 | COMPARE 2 | COMPARE 3 |
|---|---|---|---|---|---|---|
| Guidebar 1 | Knit | Knit | Knit | Knit | Knit | Knit |
| Guidebar 2 | Knit | Knit | Knit | Lay In | Lay In | Lay In |

TABLE 1-continued

| | TEST 1 | TEST 2 | TEST 3 | COMPARE 1 | COMPARE 2 | COMPARE 3 |
|---|---|---|---|---|---|---|
| Guidebar 3 | Lay In | Lay In | Lay In | Knit | Knit | Knit |
| Guidebar 1 Yarn Type | Rigid | Rigid | Rigid | Rigid | Rigid | Rigid |
| Guidebar 2 Yarn Type | Small Elastic | Small Elastic | Small Elastic | Large Elastic | Large Elastic | Large Elastic |
| Guidebar 3 Yarn Type | Large Elastic | Large Elastic | Large Elastic | Small Elastic | Small Elastic | Small Elastic |
| Stitch | FIG. 1A | FIG. 1B | FIG. 1C | | | |
| Stretch[1] warp(length) × fill (width) | 230 × 225 | 169 × 220 | 130 × 300 | 159 × 214 | Not Viable | Not Viable |
| Length Modulus 50 | 3.27 | 2.18 | 5.76 | 2.86 | Not Viable | Not Viable |
| Length Modulus 60 | 3.95 | 2.65 | 6.99 | 3.48 | Not Viable | Not Viable |
| Width Modulus 50 | 1.25 | 1.31 | 1.37 | 1.81 | Not Viable | Not Viable |
| Width Modulus 60 | 1.76 | 1.6 | 1.74 | 2.55 | Not Viable | Not Viable |
| Flex Durability[2] | 5 | 5 | 5 | 2 | Not Viable | Not Viable |
| Durability After 25 Launderings[3] | 5 | 5 | 5 | 1 | Not Viable | Not Viable |

Test Methods for Table 1

| [1]Stretch | [2]Flex Durability | [3]Durability After 25 Launderings |
|---|---|---|
| Measured in accordance with Sara Lee Intimates Test Method #14A (SLITM #14)-Spring Testing Procedure for Constant Rate of Extension (CRE) machine such as Zwick, Instron, etc. | Measured in accordance with Elastic Fabrics of America ® general flex test procedure which determines the ability of a stretch fabric to resist breakdown, which is commonly referred to as spandex run back, core retraction, and needle cutting, etc.<br>Sample Preparation and Testing:<br>1. Condition fabrics in a controlled atmosphere of 70 +/− 2 degrees F. and 65 +/− 2 percent relative humidity for a minimum of 4 hours.<br>2. Prepare three 5 inch loops each representing the warp and fill direction of the fabric.<br>3. Mount all six samples on a flex tester that is set for 75% elongation and 20 cycles per minute.<br>4. Set the flex tester for 20,000 cycles and commence test.<br>5. At the conclusion of the 20,000 cycles, wash and dry all loops following AATCC 135.<br>6. Set one pair of warp and fill loops aside to be evaluated later. Mark this set as #1.<br>7. Re-Set the tester for 20,000 cycles as described above and commence testing the remaining 4 loops.<br>8. Repeat step 5.<br>9. Repeat step 6 marking #2.<br>10. Repeat step 7 for the two remaining loops.<br>11. Repeat step 5<br>12. Repeat step 6 mark set as #3<br>Sample Evaluation:<br>Each loop is visually evaluated for spandex ends broken or pulled away from the seam, bunched or distorted loops, and frayed edges.<br>A rating of 1 to 5 is given to the fabric. A rating of 5 represents no issues while a rating of 1 represents severe deformation. | Measured in accordance with AATCC Test method 135-2004 (extended to 25 washings and 1 drying) and using the rating scale for the flex durability test. |

As shown in the above Table 1, TEST 1, TEST 2, and TEST 3 fabrics were constructed in accordance with the present invention having a small elastic yarn knit in on the middle bar and a large elastic yarn laid in on the third guidebar. The fabrics had optimal flex durability ratings of 5, even after 25 launderings.

As shown in FIGS. 1A-1C, the lapping movement in the stitches of the yarns on the three guidebars can be varied to achieve certain modulus and stretch characteristics. For example, the TEST 1 fabric made in accordance with the stitch pattern of FIG. 1A produced a fabric having substantially square stretch characteristics (230×225) in addition to the optimal flex durability ratings. It should be understood that although the middle guidebar is threaded with a knit in elastic yarn and the third guidebar is threaded with a laid in elastic yarn, the present invention is not limited to the particular lapping movement of the knit in and laid in elastic yarns, as shown in FIGS. 1A-1C. Rather, there may be some variation in the movement of the knit-in and laid in yarns while remaining within the spirit and scope of the present invention.

The COMPARE 1, COMPARE 2, and COMPARE 3 fabrics were constructed by reversing elastic yarns on the guidebars. Particularly, elastic yarns were laid in on the middle guidebar and knit it on the third guidebar. Also, the large elastic yarn was used on the middle bar and the small elastic yarn on the third guidebar. Unlike the TEST 1, TEST 2, and TEST 3 fabrics, the COMPARE fabrics were either not viable fabrics or had minimal flex durability ratings.

In view of the forgoing, the present invention is a unique fabric construction that combines tricot and raschel knitting techniques without the need of expensive weft insertion machines. Rather, the fabric can be constructed on common warp knitting machines yet replicates the aesthetic and performance characteristics of a fabric made on a weft insertion machine. Particularly, the improved fabric of the present invention virtually eliminates core retraction or slip back common to prior art knit fabrics and provides optimal durability after launderings without deterioration of the fabric properties. Fabric constructed in accordance with the present invention is suitable for many end uses, including without limitation, medical garments, swimwear, sportswear, and intimate apparel.

Certain modifications and improvements will occur to those skilled in the art upon a reading of the forgoing description of the present invention. All such modifications and improvements of the present invention have been deleted herein for the sake of conciseness and readability but are properly within the scope of the following claims.

What is claimed is:

1. A method of making knitted elastomeric fabric from three guidebars on a warp knitting machine comprising the steps of:

operating the first guidebar yarns in a repeating stitch pattern of knit-in stitches;

operating the second guidebar yarns in a repeating stitch pattern of knit-in stitches;

operating the third guidebar yarns in a repeating pattern of laid-in stitches; and fusing the second guidebar yarns to the third guidebar yarns;

wherein the first guidebar yarns are non-elastomeric yarns;

wherein the second guidebar yarns are elastomeric yarns having a denier in the range from about 20 to about 105; and wherein the third guidebar yarns are elastomeric yarns having a denier in the range from about 70 to about 560.

2. The method of claim 1 wherein the first guidebar yarns are synthetic yarns.

3. The method of claim 1 wherein the fabric exhibits a durability rating of 5.

4. The method of claim 1 wherein after 25 launderings, the fabric exhibits a durability rating of 5.

5. The method of claim 1 wherein the fabric has substantially balanced stretch characteristics.

6. The method of claim 1 wherein the fabric has greater fill (width) stretch than warp (length) stretch.

7. The method of claim 6 wherein the fill (width) stretch of the fabric is about three times greater than the warp (length) stretch.

8. The method of claim 1 wherein the fabric has substantially balanced length and width modulus.

9. A knitted elastomeric fabric comprising:

a non-elastic knit-in yarn;

a first elastic knit-in yarn; and a second elastic laid-in yarn;

wherein the first elastic knit-in yarn is fused to the second elastic laid-in yarn;

wherein the first elastic knit-in yarn has a denier in the range from a first denier to a second denier;

wherein the second elastic laid-in yarn has a denier in the range from a third denier to a fourth denier; and wherein the third denier is greater than the first denier and the fourth denier is greater than the second denier.

10. The fabric of claim 9 wherein:

the non-elastic yarn is knit-in on the first guidebar;

the first elastic yarn is knit-in on the second guidebar; and the second elastic yarn is laid-in on the third guidebar.

11. The fabric of claim 9 wherein the first elastic yarn has a denier in the range from about 20 to about 105 and the second elastic yarn has a denier in the range from about 70 to about 560.

12. The fabric of claim 9 wherein the first guidebar yarns are synthetic yarns.

13. The fabric of claim 9 wherein the fabric exhibits a durability rating of 5.

14. The fabric of claim 9 wherein after 25 launderings, the fabric exhibits a durability rating of 5.

15. The fabric of claim 9 wherein the fabric has substantially balanced stretch characteristics.

16. The fabric of claim 9 wherein the fabric has greater fill (width) stretch than warp (length) stretch.

17. The fabric of claim 16 wherein the fill (width) stretch of the fabric is about three times greater than the warp (length) stretch.

18. The fabric of claim 9 wherein the fabric has substantially balanced length and width modulus.

19. A method of making knitted elastomeric fabric from three guidebars on a warp knitting machine comprising the steps of:

operating the first guidebar yarns in a repeating stitch pattern of knit-in stitches;

operating the second guidebar yarns in a repeating stitch pattern of knit-in stitches; and operating the third guidebar yarns in a repeating pattern of laid-in stitches;

wherein the first guidebar yarns are non-elastomeric yarns;

wherein the second guidebar yarns are elastomeric yarns having a denier in the range from a first denier to a second denier;

wherein the third guidebar yarns are elastomeric yarns having a denier in the range from a third denier to a fourth denier; and wherein the third denier is greater than the first denier and the fourth denier is greater than the second denier.

20. A method of making knitted elastomeric fabric from three guidebars on a warp knitting machine comprising the steps of:

operating the first guidebar yarns in a repeating stitch pattern of knit-in stitches;

operating the second guidebar yarns in a repeating stitch pattern of knit-in stitches;

operating the third guidebar yarns in a repeating pattern of laid-in stitches; and fusing the second guidebar yarns and the third guidebar yarns;

wherein the first guidebar yarns are non-elastomeric yarns;

wherein the second guidebar yarns are elastomeric yarns;

wherein the third guidebar yarns are elastomeric yarns; and wherein the third guidebar elastomeric yarns have a greater denier than the second guidebar elastomeric yarns.

21. The method of claim 20 wherein the fabric has substantially balanced stretch characteristics.

* * * * *